United States Patent [19]

Mair

[11] Patent Number: 4,915,653

[45] Date of Patent: Apr. 10, 1990

[54] ELECTRICAL CONNECTOR

[75] Inventor: Ross L. Mair, Barrie, Canada

[73] Assignee: AMP Incorporated, Harrisburg, Pa.

[21] Appl. No.: 285,279

[22] Filed: Dec. 16, 1988

[51] Int. Cl.[4] ..... H01R 4/44; H01R 11/01

[52] U.S. Cl. ..... 439/781; 439/783

[58] Field of Search ..... 439/781, 783, 785, 805, 439/810–812, 814, 815

[56] References Cited

U.S. PATENT DOCUMENTS

| | | | |
|---|---|---|---|
| 2,106,724 | 2/1938 | Cope | 173/273 |
| 3,924,920 | 12/1975 | Moscioni et al. | 439/781 |
| 4,279,461 | 7/1981 | Bussen et al. | 439/783 |
| 4,723,920 | 2/1988 | Werner | 439/783 |
| 4,723,921 | 2/1988 | Pooley | 439/783 |
| 4,734,062 | 3/1988 | Goto | 439/783 |
| 4,764,131 | 8/1988 | Beinhaur | 439/781 |

FOREIGN PATENT DOCUMENTS 403660 9/1923 Fed. Rep. of Germany .

*Primary Examiner*—P. Austin Bradley
*Attorney, Agent, or Firm*—Allan B. Osborne

[57] ABSTRACT

An electrical connector for electrically connecting and mechanically securing two cables. More particularly, the connector includes a C-shaped member having a pair of channels facing each other and wedge block for being positioned in the C-shaped member between cables in the channels. Slanted sides of the wedge block engage and compress the cable to provide an electrical connection therebetween and to mechanically secure the cable against pull-out.

5 Claims, 4 Drawing Sheets

ELECTRICAL CONNECTOR

FIELD OF THE INVENTION

The present invention relates to electrical connectors for electrically connecting and mechanically securing two cables together by the use of a cooperating C-member and wedge block.

BACKGROUND OF THE INVENTION

It is known from U.S. Pat. No. 2,106,724 to electrically connect and mechanically secure two cables in a C-shaped resilient shell by wedging the cables therein with an insert forced in between the cables. The insert includes complementary grooves to cooperate with the grooves defined by the C-shaped shell in securing the cables. Such a construction provides an adequate electrical connection and mechanical retention for cables having a diameter which is sized to fit within the grooves within a relatively narrow range. However, if the cables fall outside the predetermined range, both the electrical connection and mechanical retention suffers. Further, with use of stranded cable, the mechanical action is such so as to preclude inter-strand movement.

Accordingly, it is now proposed to provide an electrical connector generally of the above described type which will accept a wider range of cable sizes and which includes resilient walls to provide a continued compression force against the cable for better mechanical retention.

SUMMARY OF THE INVENTION

According to the present invention, an electrical connector is provided having a C-shaped member and a wedge block. The C-shaped member includes parallel, inwardly facing channels which are spaced apart and joined by a web therebetween. The wedge block includes lateral sides which extend obliquely outwardly from a lower surface to an upper surface which engage and compress cables in the channels as the block is inserted into the C-shaped member.

DESCRIPTION OF THE INVENTION

Figure 1:
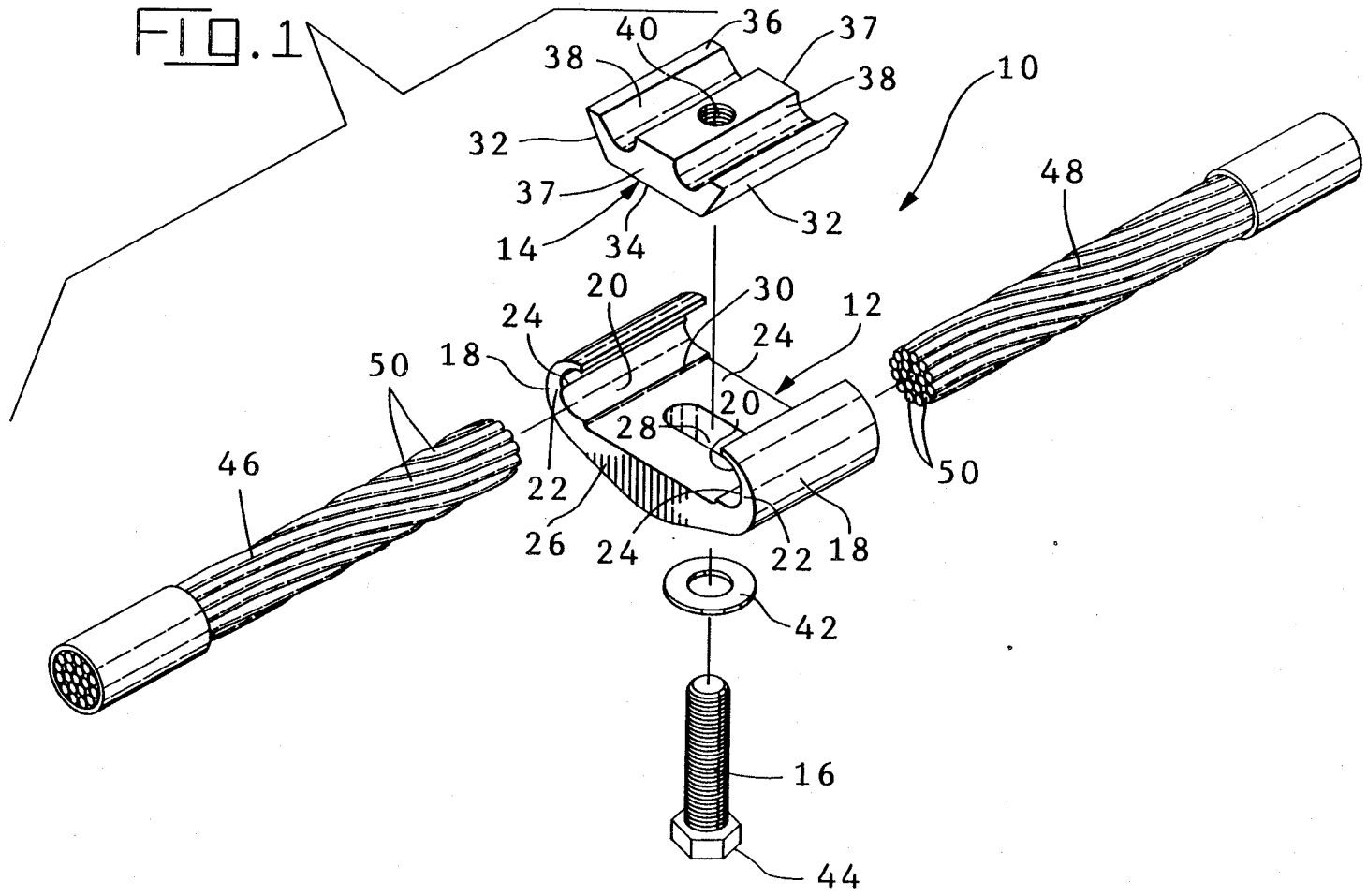
FIG. 1 is an exploded, perspective view of an electrical connector of the present invention.

With reference to FIG. 1, electrical connector 10 includes C-shaped member 12, wedge block 14 and bolt 16. Member 12 and block 14 are preferably extruded with the preferred material being 6061-t6 aluminum.

The longitudinal edges of C-shaped member 12 are rolled over to define channel portions 18 and to provide parallel, interior curve channels 20. The radius of channels 20 is compounded by an inwardly projecting, longitudinal extending rib 22. As shown, ribs 22 are pointed; however, they could be rounded or even squared-off (not shown).

Channels 20 face each other across surface 24 of web 26 which joins portions 18. An elongated hole 28 extends through web 26 with the major axis thereof being normal to channels 20. Further, surface 22 is stepped down from channel portions 18 as indicated by shoulders 30.

Figure 2:
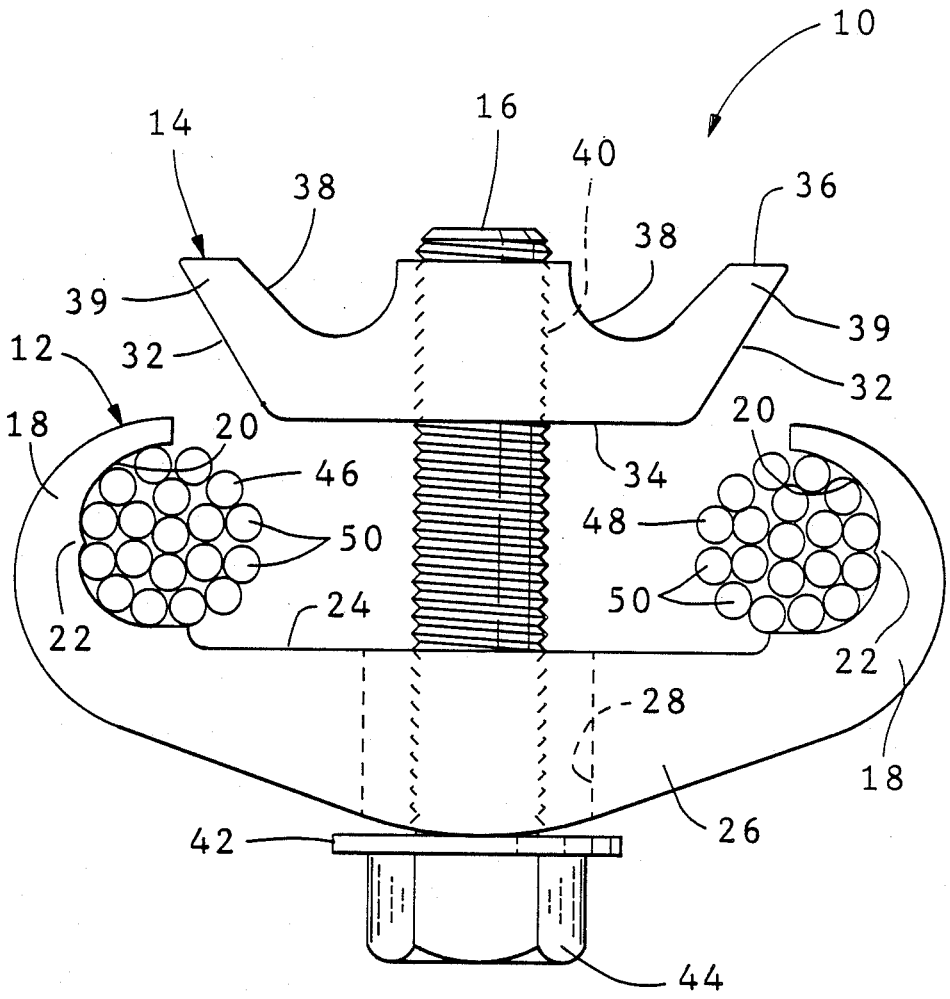
FIG. 2 is an end view of the electrical connector about to secure cables therein.

Wedge block 14 has a trapezoid shape as viewed from an end; i.e., sides 32 extend obliquely outwardly from bottom surface 34 to upper surface 36. Relative to surface 34, sides 32 are at an angle of about 58 degrees. End walls 37 are normal to surfaces 34, 36 but they could be formed to extend obliquely from surface 34 to surface 36. A pair of longitudinal grooves 38 are provided in upper surface 36 adjacent respective sides 32 to define longitudinally extending resilient walls 39. A threaded bore 40 extends through the thickness of block 14, opening onto bottom surface 34 and upper surface 36 between grooves 38. As shown in FIG. 2, bolt 16 extends freely through hole 28 and is threadedly received in bore 40 with a suitable washer 42 between bolt head 44 and web 26.

Also shown in FIG. 1 are cables 46, 48, composed of strands 50 which may be electrically connected and mechanically retained by connector 10.

FIG. 2 shows connector 10 assembled; i.e., bolt 16 passing through hole 28 in C-shaped member 12 and threaded into bore 40 in block 14. Block 14 is orientated so that lower surface 34 faces surface 22 of member 12 and sides 32 obliquely face cables 46, 48 positioned in respective channels 20.

Figure 3:
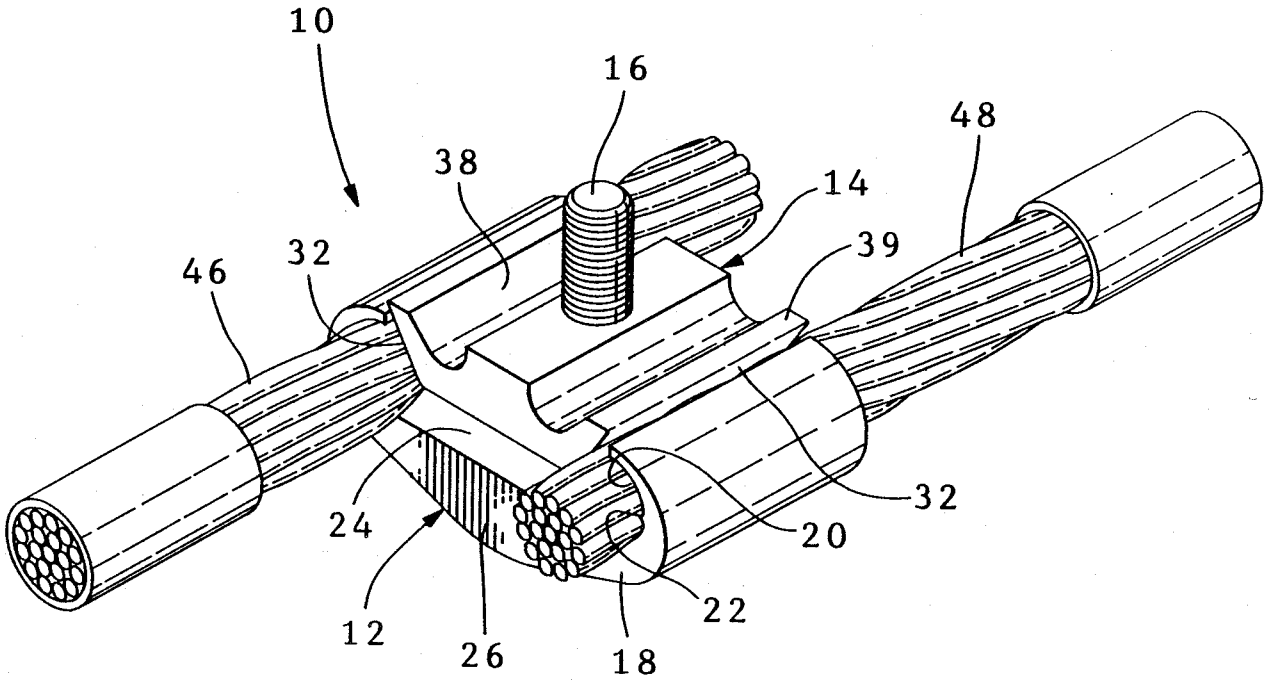
FIG. 3 is a perspective view of two cables electrically connected and mechanically secured in the electrical connector.

FIG. 3 shows connector 10 with cables 46, 48 secured therein by drawing wedge block 14 into C-shaped member 12. As sides 32 engage cables 46, 48, individual strands 50 are compressed into a tighter relation with one another and in the process, oxides and other contaminates are scraped off to enhance electrical conductivity therebetween. Further, the direction of contact force changes and the component of contact force in the direction of wedge installation; i.e., towards member 12, decreases and accordingly reduces the torque required to draw wedge block 14 further into member 12.

As is apparent, block 14 is pulled into member 12 by rotating bolt 16. In those cases where cables 46, 48 are of unequal diameters, block 14 will be shifted automatically towards the smaller size cable by reason of hole 28 being elongated.

Further, as block 14 is being drawn into C-shaped member 12, walls 39 are resiliently deformed towards grooves 38, thereby storing forces which may be exerted against cables 46, 48 should their compressed diameters decrease due to thermal contraction.

Figure 4:
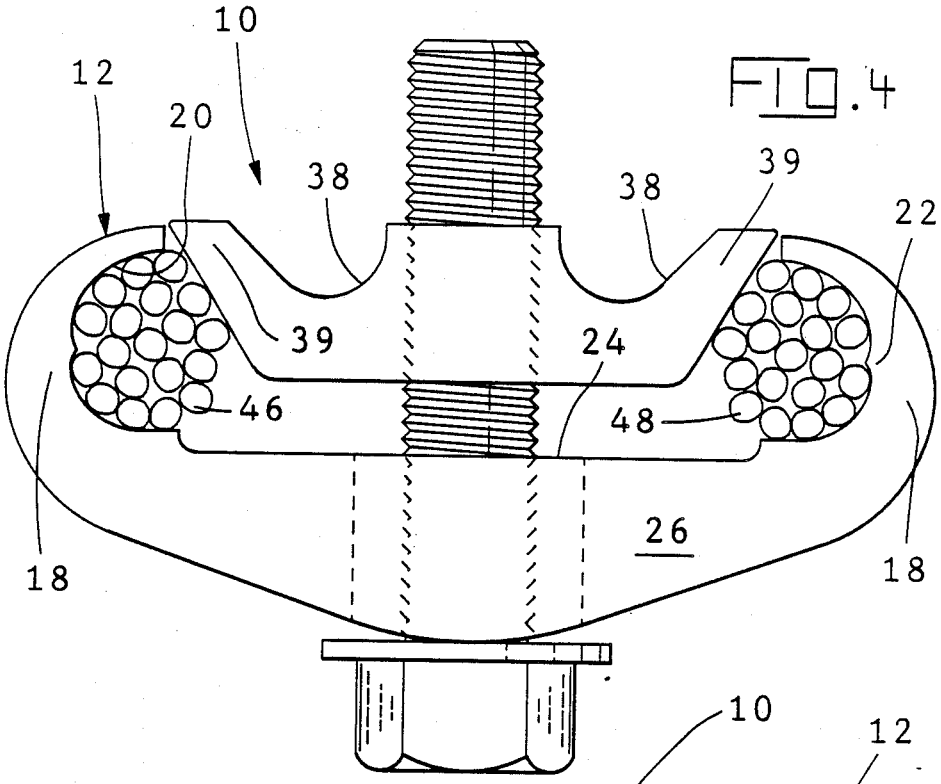
FIGS. 4 and 5 are end views showing cables of different sizes secured in the electrical connector.
Figure 5:
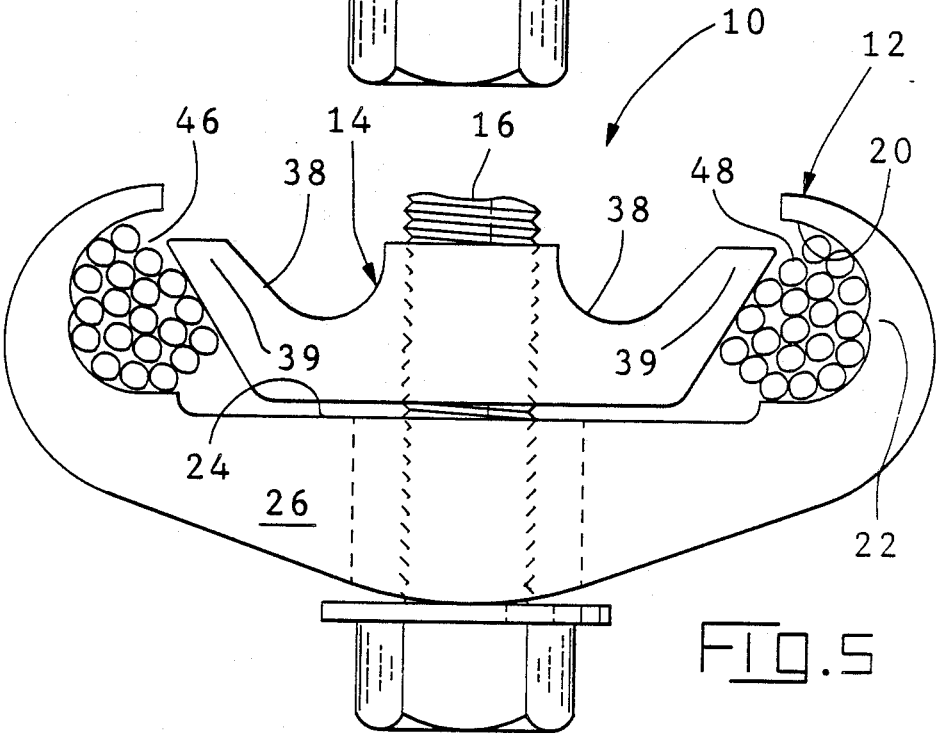

FIGS. 4 and 5 are end views showing the relation of wedge block 14 to cables 46, 48 of different sizes. In FIG. 4, the cables are so large that full compression thereof is reached with block 14 being partially drawn into member 12. Contra, as shown in FIG. 5, the cables are so small that block 14 almost touches surface 24 of web 26.

In both events, walls 39 are resiliently deformed to some degree as noted above. Further, in the case of FIG. 4, channel portions 18 of C-shaped member 12 may be resiliently forced outwardly so that cables 46, 48 are between two forces bearing thereagainst.

The compound radius of channels 20 provided by ribs 22 advantageously insure a minimum two-point contact for even the smallest cable sizes for adequate electrical contact.

As can be discerned, an electrical connector has been disclosed which is capable of accepting and retaining a wide range of cable sizes. The connector includes C-shaped member having parallel, inwardly open channels joined by a web extending therebetween and a wedge block having resilient, obliquely projecting walls on each side which, as the wedge block is drawn into the C-shaped member, engage cables which are positioned in the channels to compressingly secure them therein. Further, the resilient walls deform so as to provide a continuous force against the cables and thereby prevent a slack connection due to thermal contraction.

I claim:

1. An electrical connector for electrically connecting and mechanically securing two cables, said connector comprising:

a C-shaped member having parallel, inwardly facing channels spaced apart and joined by a web extending therebetween, said channels having a compound curving radius;

a wedge block having lateral sides extending obliquely outwardly from a lower surface to an upper surface, said wedge block adapted to be drawn into said C-shaped member between said channels so that said sides engage cables which may be in said channels and to thereby compress and secure the cables therein; and means to draw said wedge block into said C-shaped member.

2. The connector according to claim 1 wherein grooves are provided in said upper surface of said wedge block adjacent said sides to define resilient wall means which resiliently deform as said sides engage the cables.

3. The connector according to claim 1 wherein said compound radius is provided by inwardly projecting, longitudinally extending the rib means on said channel surfaces.

4. The connector according to claim 3 wherein said sides extend obliquely outwardly at about an angle of 58 degrees relative to said lower surface of said wedge block.

5. The connector according to claim 4 wherein said means for drawing said wedge block into said C-shaped member includes a bolt extending through said web and threadedly received in said wedge block.

* * * * *